US005820775A

United States Patent [19]

Hiller et al.

[11] Patent Number: 5,820,775

[45] Date of Patent: Oct. 13, 1998

[54] TEXTILE SHEET FOR USE AS A CONCRETE MOLD LINER

[75] Inventors: Stefanie Hiller, Gerabronn; Christian Hassmann, Waldems; Andreas Schaab, Aschaffenburg, all of Germany

[73] Assignee: Hoechst Trevira GmbH & Co. KG, Germany

[21] Appl. No.: 873,732

[22] Filed: Jun. 12, 1997

[30] Foreign Application Priority Data

Jun. 13, 1996 [DE] Germany ..... 196 23 584.7

[51] Int. Cl.[6] ..... E04G 9/10; B28B 7/36

[52] U.S. Cl. ..... 249/113; 249/134; 264/175; 428/317.1; 428/338

[58] Field of Search ..... 249/112, 113, 249/134; 264/175, 103; 428/317.1, 338, 339

[56] References Cited

U.S. PATENT DOCUMENTS

| | | | |
|---|---|---|---|
| 4,472,339 | 9/1984 | Van Der Ploeg et al. | 249/113 |
| 4,787,597 | 11/1988 | Yokota et al. | 249/113 |
| 4,856,754 | 8/1989 | Yokota et al. | 249/113 |
| 5,124,102 | 6/1992 | Serafini | 249/113 |
| 5,135,692 | 8/1992 | Serafini | 249/113 |
| 5,302,099 | 4/1994 | Serafini | 249/113 |

*Primary Examiner*—James P. Mackey
*Attorney, Agent, or Firm*—Connolly & Hutz

[57] ABSTRACT

The present invention relates to a concrete mold liner and to molds for concrete production which produce patterned or very smooth concrete surfaces.

18 Claims, No Drawings

TEXTILE SHEET FOR USE AS A CONCRETE MOLD LINER

BACKGROUND OF THE INVENTION

The present invention relates to a concrete mold liner and to molds produced therefrom for the production of concrete which give patterned or very smooth concrete surfaces.

In the production of concrete, the latter is usually cast using a concrete mold, the concrete assuming the shape of the concrete mold. The wet concrete is poured into or onto the concrete mold, the newly exposed concrete surface after curing and removal of the concrete mold representing a negative impression of the inside surface of the concrete mold. In the case of wooden molds, the concrete assumes the appearance of the wood grain. In the case of molds with incorporated mold elements, the concrete shows all the seams which are not adequately covered.

The concrete mixture often has more water added to it than is required for hydration. In addition, the concrete mixture contains air. Both constituents (air and water) are of use to make the mixture flowable and to facilitate handling and pouring.

The completely hydrated concrete may bind within it about 40% by weight of water, so that excess water remains in the concrete. After drying out of the concrete, this is responsible for the formation of so-called capillary pores. The air present in the concrete mixture can be removed, at least to the greatest extent, by suitable compacting measures. However, due to the different densities of the constituents (aggregates) of the concrete mixture, this changes the physical and chemical properties of the concrete, so that in some cases incipient segregation of the concrete is to be observed.

In addition, the fresh concrete in the formwork contains more cement and water in the outer zone. This cement- and water-rich mixture is also referred to as concrete paste. The associated change in the water/cement ratio (W/C ratio) in comparison with the mass concrete has a lower durability of the concrete surface as a consequence.

The points made above indicate the problems which arise in the production of durable concrete surfaces. Due to excess water, concrete with a weakened surface (high concrete paste content) is obtained, while the air which has not been removed produces surface pores (capillary pores). Depending on the type of concrete, the size of the pores is between 0.1 and 3 cm. These pores leave behind an uneven surface, which is open to the effects of dirt and erosion and those caused by the freezing-thawing cycles of water. Such a surface is not very durable if subjected to severe stress.

Concrete shutterings are known from the prior art.

For instance, U.S. Pat. No. 4,730,805 describes a concrete mold which uses a support and at least two layers of textile sheet on the support. The support may have attachments to keep the sheet at a distance from the support, the layers of sheet and the attachments assisting in the draining of the water from the curing concrete. The support may have drainage holes for the removal of excess water and air. The sheet is also bound to the support and is rigid and immovable with respect to the support.

U.S. Pat. No. 4,856,754 discloses a concrete mold using doubly woven textile sheets on a supporting board with holes for drainage. One woven sheet is adhesively attached to the board, while the other woven sheet is sewn to the first.

EP-A-0 429 752 discloses a mold for a patterned concrete having a supporting means, a grid with interconnected spacing elements, which form in the grid holes with an individual surface area of at least 0.25 $cm^2$, at least some of these elements resting on the supporting means, and a porous, textile sheet, which is arranged next to the grid and by means of which the grid is arranged at a distance from the support. This sheet generally has on each side a pore size of from 10 to 250 microns, so that a number of small concrete particles can penetrate into the open spaces of the sheet and fill them, and excess water and air can pass through.

Fine concrete particles typically fill the larger pores of the sheet, in particular if excessive concrete compaction occurs. If sufficient fine concrete particles have penetrated into the structure of the sheet and adequate concrete hardening has taken place, the detachment of the sheet from the hardened concrete is usually very difficult or even impossible. This takes place since the concrete particles which have penetrated into the sheet and hardened therein pull out the fibers of the sheet from its surface when the sheet is separated from the concrete. The problem worsens if the sheet with loose surface fibers is reused, since the loose fibers tend to become embedded in the cured concrete, thereby causing a flaking of the sheet mat. The problem is exacerbated if the sheet is not handled with care during the assembly or disassembly of the mold, since the mechanical friction (for example abrasion) tends to make the sheet napped and to cause the loose fibers to stick to the concrete. Repeated use of sheet molds causes even more pores in the sheet to become even more clogged with fine concrete particles, which has the effect of greatly reduced elimination of water and air.

German Utility Model G 9117039 discloses a concrete mold liner containing a porous two-sided, textile sheet having a smooth side and a less smooth side. The size of the pores on the smooth side is between 0.2 and 10 $\mu$m, while the less smooth side has pores of a size of between 10 and 250 $\mu$m. The smooth (first) side is produced either by a microfoam coating or by fibers of lower titer than the less smooth (second) side, and subsequent calendering. The latter possibility presupposes different titers (i.e. a titer gradient) in the textile sheet. The treatment for producing the smooth surface at the same time brings about a stabilization of the textile sheet.

The concrete mold liners described above can be created only with great effort, so that there was a need for further concrete mold liners which are simple to create. In particular, it is intended for the complex stabilization of the concrete mold liner to be easily possible.

SUMMARY OF THE INVENTION

It has surprisingly been found that nonwovens of fine titer have an adequate drainage effect for air and water and, in addition, have the required surface quality.

The invention relates to a concrete mold liner comprising a nonwoven, wherein a) the nonwoven is made up from fibers of which the titers are between 0.7 and 3 dtex, preferably between 1 and 2.5 dtex, in particular between 1 and 2 dtex, b) the nonwoven has a maximum tensile strength of at least 300 N, preferably at least 400 N, in particular at least 500 N, in the longitudinal direction and at least 250 N, preferably at least 300 N, in particular at least 350 N, in the transverse direction, measured on a strip 5 cm wide, and c) has a surface quality corresponding to a pore size of from 1 to 80 $\mu$m, preferably from 5 to 60 $\mu$m.

DETAILED DESCRIPTION OF THE INVENTION

The nonwovens may be made up from fibers of finite length, so-called staple-fiber nonwovens, or from fibers of infinite length, so-called spunbonded nonwovens. The fibers are derived from any desired thermoplastic filament-forming polymers. Examples of such melt-spinnable polymer materials are polyamides, such as for example polyhexamethylenediadipamide, polycaprolactams, aromatic or partly aromatic polyamides ("aramids"), partly aromatic or fully aromatic polyesters, polyphenylene sulfide (PPS), polymers with ether and keto groups, such as for example polyetherketones (PEK) and polyetheretherketone (PEEK), or polybenzimidazoles.

Of the spunbonded nonwovens, preferred are so-called melt-binder-consolidated spunbonded nonwovens, which are produced by a random deposit of freshly melt-spun filaments. They are usually composed of carrier fibers and binder fibers.

The carrier fibers and binder fibers may be derived from any desired thermoplastic filament-forming polymers in accordance with the user's set of requirements. The proportion of the two types of fiber in relation to each other can be chosen within broad limits, it having to be ensured that the proportion of binder fibers is chosen to be high enough for the nonwoven to be given adequate strength and surface quality for the desired application by means of the carrier fibers adhesively bonding with the binder fibers. In the nonwoven, the proportion of the binder originating from the binder fibers is usually less than 50% by weight, preferably 3 to 25% by weight, based on the weight of the nonwoven.

Suitable carrier fibers are melt-spinnable polymer materials, for example polyamides, such as for example polyhexamethylenediadipamide, polycaprolactam, aromatic or partly aromatic polyamides (aramids), partly aromatic or fully aromatic polyesters, polyphenylene sulfide (PPS) polymers with ether and keto groups, such as for example polyetherketones (PEK) and polyetheretherketone (PEEK), or polybenzimidazoles.

It is preferred for the carrier fibers to consist of melt-spinnable polyesters. To be considered for the polyester material are in principle all known types suitable for fiber production. Such polyesters predominantly comprise constitutional units which are derived from aromatic dicarboxylic acids and from aliphatic diols. Common aromatic dicarboxylic acid constitutional units are the divalent radicals of benzene dicarboxylic acids, in particular of terephthalic acid and of isophthalic acid; common diols have 2 to 4 carbon atoms, ethylene glycols being particularly suitable. Particularly advantageous are nonwovens which are composed of a polyester material of which at least 85 mol. % is polyethylene terephthalate. The remaining 15 mol. % are then made up of dicarboxylic acid units and glycol units, which act as so-called modifiers and which allow a person skilled in the art to influence with specific intent the physical and chemical properties of the filaments produced. Examples of such dicarboxylic acid units are radicals of isophthalic acid or of aliphatic dicarboxylic acid, such as for example glutaric acid, adipic acid, sebacic acid; examples of diol radicals with a modifying action are those of relatively long-chain diols, for example of propanediol or butanediol, of diethylene or triethylene glycol or, if present in a small amount, of polyglycol with a molecular weight of from about 500 to 2000.

Particularly preferred are carrier fibers of polyester which contain at least 95 mol. % of polyethylene terephthalate, in particular those of unmodified polyethylene terephthalate.

The polyesters contained in the nonwovens usually have a molecular weight corresponding to an intrinsic viscosity (IV) of from 0.5 to 1.4 (dl/g), measured on solutions in dichloroacetic acid at 25° C.

To be considered for the binder fibers are all polymer materials with a melting point lowered in comparison with the raw material of the carrier fibers by at least 1° C., preferably 10° to 50° C., with particular preference 30° to 50° C. It is preferred if these are modified polyester fibers or polyolefins such as polypropylene or polyethylene, polybutylene terephthalate or polyethylene terephthalate modified by condensing down relatively long-chain diols and/or isophthalic acid or aliphatic dicarboxylic acids. The melt binders are preferably introduced into the nonwovens in fiber form (endless spinnable fibers or staple fibers). The individual fiber titers of the carrier fibers are 0.7 to 3 dtex, preferably 1 to 2.5 dtex. The individual fiber titer of the binder fibers is between 1 and 10 dtex, preferably from 1 to 4 dtex. It is particularly advantageous if the binder fibers have the same titer as the carrier fibers. In addition, fibers which combine the carrying and binding properties may also be used. Examples of these are so-called heterofil and bicomponent fibers.

Further suitable spunbonded fibers are also those which are consolidated by a chemical binder, for example on an acrylate base.

Further suitable spunbonded nonwovens are thermally consolidated spunbonded nonwovens. Such spunbonded nonwovens usually contain no melt binder as described above and are consolidated merely by exposure to heat and/or pressure, for example calendering.

In the case of the staple-fiber nonwovens, there is no restriction on the length of the staple fibers. The staple-fiber nonwovens are composed of the same polymer materials as the spunbonded nonwovens described above. Suitable staple-fiber nonwovens are thermally consolidated staple-fiber nonwovens, i.e. those which are consolidated by exposure to heat and/or pressure, for example calendering. In addition, staple-fiber nonwovens consolidated with a binder are also suitable, irrespective of whether it is a melt binder in the above sense or a chemical binder, for example on an acrylate base. What is important is that the staple-fiber nonwoven has the required surface quality and mechanical properties.

The nonwovens have weights per unit area of from 50 to 300 g/m$^2$ preferably 130 to 250 g/m$^2$, in particular 140 to 170 g/m$^2$.

The carrier fibers and binder fibers preferably belong to a polymer class (for example polyester), so that the concrete mold liner according to the invention can be reused without any problems.

The nonwovens, in particular the spunbonded nonwovens, are calendered under the effect of heat and pressure after their production, so that the binder fibers ensure adequate consolidation of the nonwoven. As a rule, the calendering temperature is between 240° and 250° C.; the calendering pressure (linear pressure) is between 135 and 145 daN.

By calendering, an embossed pattern can be produced on at least one of the two sides of the nonwoven. The embossing is produced by means of a calender roll of which the embossing depth is between 0.1 and 0.5 mm, preferably from 0.2 to 0.3 mm. The linear pressure is in this case between 135 and 145 daN. The embossing pattern is preferably a linen embossing pattern. The embossing area is between 40 and 50% (based on the surface area of the corresponding side).

In addition, the nonwoven may also be preconsolidated by suitable measures, for example mechanically by needle-punching and/or by means of fluid jets, before the calendering described above.

The nonwoven has a maximum tensile strength of at least 300 N, preferably at least 400 N, in particular at least 500 N, particularly preferably 400 to 600 N (in the longitudinal direction) and at least 250 N, preferably at least 300 N, in particular at least 350 N, particularly preferably 300 to 500 N (in the transverse direction), measured on a strip 5 cm wide, in accordance with DIN EN 29073.3.

The surface quality of the nonwoven corresponds to a pore size (cross section) of from 1 to 80 $\mu$m, preferably 5 to 60 $\mu$m, determined by means of a Coulter porometer in porofil.

The nonwoven has an air permeability of up to 250 $l/m^2s$ at 200 Pa (determined in accordance with DIN 53887) and a waterproofness of from 40 to 300 mm water column (determined in accordance with DIN 53886).

Particularly preferred are also those nonwovens which have a combination of preferred features.

The fibers or staple fibers making up the nonwovens may have a virtually round cross section or else have different shapes, such as dumbbell-shaped, kidney-shaped, triangular or trilobate or multilobate cross sections. Hollow fibers can also be used. Preferred are round to oval fiber cross sections. Furthermore, the binder fibers can also be used in the form of bicomponent or multicomponent fibers, oval to round cross sections resulting in an improved bonding in of the fibers and consequently better surface quality.

The fibers forming the nonwoven may be modified by customary additives, for example by antistatic agents, such as carbon black.

In a further embodiment of the invention, to increase the water repellency, fluorine-containing polymers are incorporated in the concrete mold liner according to the invention, so that the detachment of the concrete mold liner from the cured concrete is assisted. An example of a suitable water repellent is the product commercially available under the name ®Nuva (Hoechst AG, Germany).

For a person skilled in the art, it was surprising that nonwovens of fine titer meet the requirements demanded of a concrete mold liner with regard to surface quality and mechanical strength. In particular, it is surprising that the surface quality required can be achieved merely by a nonwoven, and not only if there is a foam coating, so that the time-consuming and costly foam coating can be dispensed with. In addition, the titer gradient described in the prior art is not necessary, so that these steps can be dispensed with as well.

The nonwovens according to the invention are of high mechanical strength and can be exposed to high loads. These tensile forces, occurring in particular during tensioning of the concrete mold liner, may result in tearing, so that at least partial destruction of the concrete mold liner is to be feared. Furthermore, the high mechanical strength is favorable, since high tensile strengths are necessary during tensioning of the concrete mold liner in order to ensure a surface without folds.

The present invention also relates to a process for producing the concrete mold liner according to the invention, comprising the measures:

a) forming a nonwoven from fibers of which the titer is between 0.7 and 3 dtex, b) consolidating the formed nonwoven by means of a calender, so that adequate strength and surface quality are obtained.

A preferred way of forming the nonwoven according to measure a) is that of spunbond formation with simultaneous forming of the binder fibers.

The calendering described according to b) takes place at temperatures between 240° and 250° C. and a calender pressure of from 135 to 145 daN (linear pressure). At the same time as this, an embossed pattern, preferably a linen embossed pattern, can be produced.

The nonwoven is a melt-binder-consolidated spunbonded nonwoven, so after step b) there follows a final consolidation by melting the binder fibers, for example in a circulated-air oven.

If the nonwoven is consolidated with a chemical binder, it is usually applied after step b) and the nonwoven is subsequently subjected to a thermal post-treatment, so that the binder cures.

The present invention also relates to the use of the concrete mold liner according to the invention for producing a concrete mold, to which the present invention also relates.

The invention also relates to a concrete mold for producing a patterned concrete surface, comprising:

(a) a supporting means;

(b) a grid with interconnected spacing elements, which form in the grid holes with an individual surface area of at least 0.25 $cm^2$ for producing the patterned surface, at least some of the spacing elements resting on the supporting means, (c) a nonwoven which is made up from fibers of which the titers are between 0.7 and 3 dtex, preferably between 1 and 2.5 dtex, in particular between 1 and 2 dtex and has a minimum tensile strength of at least 300 N, preferably at least 400 N, in particular at least 500 N, in the longitudinal direction and at least 250 N, preferably at least 300 N, in particular at least 350 N, in the transverse direction, measured on a strip 5 cm wide and has a surface quality corresponding to a pore size of from 1 to 80 $\mu$m, preferably from 5 to 60 $\mu$m.

In addition, there is likewise provided a process for producing the improved mold by forming a support with the mold, which is desired for a concrete article to be produced, fastening a grid on the support (a), the grid having interconnected spacing elements, of which at least some rest on the support (a) and adjacently arranging a spunbonded nonwoven (c) together with the grid (b), the spunbonded nonwoven (c) being kept at a distance from the support (a) by the grid (b).

The process may comprise, furthermore, uniform stretching of the spunbonded nonwoven (c) over the grid (b) with a tensioning from 0.2 to 3.0 kg per running centimeter, and is consequently also suitable for producing a concrete mold for concrete with a smooth surface, to which the invention likewise relates. The process of the present invention also comprises forming a supporting means (a) with holes and arranging the spunbonded nonwoven (c) adjacent to the supporting means (a), so that, if appropriate, the grid (b) can be dispensed with.

The production of such concrete molds is described in detail in German Utility Model G 9117089.

We claim:

1. A concrete mold liner comprising a nonwoven, wherein a) the nonwoven is made up from fibers of which the titers are between 0.7 and 3 dtex, b) the nonwoven has a maximum tensile strength of at least 300 N, in the longitudinal direction and at least 250 N in the transverse direction, measured on a strip 5 cm wide, and c) has a surface quality corresponding to a pore size of from 1 to 80 $\mu$m.

2. The concrete mold liner as claimed in claim 1, wherein the nonwoven is made up from fibers of which the titers are between 1 and 2.5 dtex.

3. The concrete mold liner as claimed in claim 1, wherein the nonwoven is made up from fibers of which the titers are between 1 and 2 dtex.

4. The concrete mold liner as claimed in claim 1, wherein the nonwoven has a maximum tensile strength of at least 400 N in the longitudinal direction and at least 300 N in the transverse direction, measured on a strip 5 cm wide.

5. The concrete mold liner as claimed in claim 1, wherein the nonwoven has a maximum tensile strength of at least 500 N in the longitudinal direction and at least 350 N in the transverse direction, measured on a strip 5 cm wide.

6. The concrete mold liner as claimed in claim 1, wherein the surface quality corresponds to a pore size of from 5 to 60 $\mu$m.

7. The concrete mold liner as claimed in claim 1, wherein the nonwoven is a spunbonded nonwoven or a staple-fiber nonwoven.

8. The concrete mold liner as claimed in claim 7, wherein the spunbonded nonwoven is a melt-binder-consolidated spunbonded nonwoven.

9. The concrete mold liner as claimed in claim 8, wherein the melt-binder-consolidated spunbonded nonwoven includes binder fibers in an amount less then 50% by weight based on the weight of the nonwoven.

10. The concrete mold liner as claimed in claim 9, wherein the individual fiber titers of the binder fibers are from 1 to 10 dtex.

11. The concrete mold liner as claimed in claim 1, wherein the nonwoven has a weight per unit area of from 50 to 250 g/m$^2$.

12. The concrete mold liner as claimed in claim 1, wherein the nonwoven has a weight per unit area of from 130 to 170 g/m$^2$.

13. The concrete mold liner as claimed in claim 1, wherein the nonwoven is calendered under the effect of heat and pressure after its production.

14. The concrete mold liner as claimed in claim 13, wherein the nonwoven has an embossed pattern on at least one of the two sides.

15. The concrete mold liner as claimed in claim 1, wherein the nonwoven has an air permeability of up to 250 l/m$^2$s at 200 Pa (determined in accordance with DIN 53887) and a waterproofness of from 40 to 300 mm water column (determined in accordance with DIN 53886).

16. A process for producing the concrete mold liner as claimed in claim 1, comprising the measures:

a) forming a nonwoven from fibers of which the titer is between 0.7 and 3 dtex, b) consolidating the formed nonwoven by means of a calender, so that adequate strength and surface quality are obtained.

17. A concrete mold for producing a patterned concrete surface, comprising:

(a) a supporting means;

(b) a grid with interconnected spacing elements, which form in the grid holes with an individual surface area of at least 0.25 cm$^2$ for producing the patterned surface, at least some of the spacing elements resting on the supporting means, (c) a nonwoven which is made up from fibers of which the titers are between 0.7 and 3 dtex and has a maximum tensile strength of at least 300 N in the longitudinal direction and at least 250 N in the transverse direction, measured on a strip 5 cm wide and has a surface quality corresponding to a pore size of from 1 to 80 $\mu$m.

18. A concrete mold for producing a smooth concrete surface, comprising:

(a) a supporting means, (b) a nonwoven which is made up of fibers of which the titers are between 0.7 and 3 dtex and has a maximum tensile strength of at least 300 N in the longitudinal direction and at least 250 N in the transverse direction, measured on a strip 5 cm wide and has a surface quality corresponding to a pore size of from 1 to 80 $\mu$m.

* * * * *

UNITED STATES PATENT AND TRADEMARK OFFICE

CERTIFICATE OF CORRECTION

PATENT NO. : 5,820,775

DATED : October 13, 1998

INVENTOR(S) : Stefanie Hiller et al

It is certified that error appears in the above-identified patent and that said Letters Patent is hereby corrected as shown below:

Column 7, line 31 (claim 12, line 1), "1" should read – 11 –.

Signed and Sealed this

Ninth Day of February, 1999

*Attest:*

*Attesting Officer*

*Acting Commissioner of Patents and Trademarks*